US009242783B2

(12) United States Patent
Cho

(10) Patent No.: US 9,242,783 B2
(45) Date of Patent: Jan. 26, 2016

(54) CONTAINER CAP USING BOTTOM GASKET TO ACCOMMODATE AND DISCHARGE ADDITIVES

(71) Applicant: JCTECH CO., LTD, Incheon (KR)

(72) Inventor: Youngkook Cho, Marietta, GA (US)

(73) Assignee: JCTECH CO., LTD (KR)

( * ) Notice: Subject to any disclaimer, the term of this patent is extended or adjusted under 35 U.S.C. 154(b) by 0 days.

(21) Appl. No.: 14/422,461

(22) PCT Filed: Mar. 27, 2013

(86) PCT No.: PCT/KR2013/002515
§ 371 (c)(1),
(2) Date: Feb. 19, 2015

(87) PCT Pub. No.: WO2014/030818
PCT Pub. Date: Feb. 27, 2014

(65) Prior Publication Data

US 2015/0217924 A1 Aug. 6, 2015

(30) Foreign Application Priority Data

Aug. 20, 2012 (KR) ..... 10-2012-0090975

(51) Int. Cl.
*B65D 25/08* (2006.01)
*B65D 81/32* (2006.01)
*B65D 51/28* (2006.01)

(52) U.S. Cl.
CPC ..... *B65D 81/3216* (2013.01); *B65D 25/08* (2013.01); *B65D 51/2892* (2013.01); *B65D 51/2857* (2013.01); *B65D 51/2864* (2013.01)

(58) Field of Classification Search
CPC ..... B65D 25/08; B65D 51/2857; B65D 51/2864; B65D 51/2892; B65D 81/3216
USPC ..... 206/219–222, 568; 215/6, 227, 228, 215/DIG. 8
See application file for complete search history.

(56) References Cited

U.S. PATENT DOCUMENTS 4,386,696 A * 6/1983 Goncalves ..... B65D 51/2871 206/219
6,293,395 B1 * 9/2001 Hof ..... B65D 81/3211 206/219

(Continued)

FOREIGN PATENT DOCUMENTS

KR 10-2009-0009069 A 1/2009
KR 10-2009-0014699 A 2/2009

(Continued)

OTHER PUBLICATIONS

International Search Report prepared by the Korean Intellectual Property Office on Jul. 17, 2013, for International Application No. PCT/KR2013/002515, (4 pages).

*Primary Examiner* — Luan K Bui
(74) *Attorney, Agent, or Firm* — Sheridan Ross P.C.

(57) ABSTRACT

A container closure for an additive includes: a storage member having an outlet port formed in the lower side surface of a tubular inner cap arranged inside the entrance of the container in a main cap coupled to the entrance of the container; an opening member which has a slider sliding in the vertical direction in the inner cap, and is coupled to an extended tube extending upwardly from the main cap; a bottom gasket which closes the lower end and inner surface of the slider, is hooked onto the storage member, and is separated from the slider when separating the opening member; and a bottom inner cap which is integrally formed with the lower end of the outlet port, and concurrently tightly seals the outer surface, the bottom surface, and the inner surface of the bottom gasket.

9 Claims, 11 Drawing Sheets

(56) References Cited

U.S. PATENT DOCUMENTS

| | | | | |
|---|---|---|---|---|
| 6,921,087 | B2 * | 7/2005 | Takahashi | B65D 51/2878 206/219 |
| 7,588,142 | B1 * | 9/2009 | Bush | B65D 51/2857 206/221 |
| 2005/0211579 | A1 * | 9/2005 | Makita | B65D 51/2878 206/219 |
| 2009/0057262 | A1 * | 3/2009 | Cho | B65D 11/0083 215/228 |
| 2009/0139882 | A1 * | 6/2009 | DeJonge | B65D 51/2892 206/219 |
| 2010/0276308 | A1 * | 11/2010 | Lee | B65D 25/08 206/219 |
| 2013/0112646 | A1 * | 5/2013 | Cho | B65D 51/28 215/227 |

FOREIGN PATENT DOCUMENTS

| | | | |
|---|---|---|---|
| KR | 10-2010-0099660 | A | 9/2010 |
| KR | 10-2011-0086488 | A | 7/2011 |
| KR | 10-2012-0072582 | A | 7/2012 |

* cited by examiner

CONTAINER CAP USING BOTTOM GASKET TO ACCOMMODATE AND DISCHARGE ADDITIVES

CROSS REFERENCE TO RELATED APPLICATIONS

This application is a national stage application under 35 U.S.C. 371 and claims the benefit of PCT Application No. PCT/KR2013/002515 having an international filing date of Mar. 27, 2013, which designated the United States, which PCT application claimed the benefit of Korean Patent Application No. 10-2012-0090975 filed Aug. 20, 2012, the disclosures of each of which are incorporated herein by reference in their entirety.

TECHNICAL FIELD

The present invention relates to a container cap for accommodating and discharging additives using a bottom gasket.

BACKGROUND ART

In general, a two-compartment container which serves to accommodate an additive in a container cap and then allow the additive to introduce into the contents within the container upon opening of the container, cap has been known, for example, in U.S. Pat. No. 3,924,741 This container includes a stopper 2 having a skirt 6 screwed onto the outside screw part of the mouth 3 of the bottle 1, and a closure cap 21 for accommodating and discharging an additive 28 while moving up and down coaxially to a cylindrical sleeve 7 within a stopper 2.

The stopper 2 includes a transverse wall 8 in which the lower end of a cylindrical sleeve 7 extending downwardly from the top of ae skirt 6 to the inside of the mouth of a bottle is closed, and a plurality of side apertures 9 that pass through a portion around the side of a transverse wall 8. Shoulders 14, 16 for limiting the movement of the capsule to its upper terminal position are, respectively, formed in the inside of a protrusion part 19 protruded over a horizontal surface so that it forms the upper end of the skirt 6 at the upper end of the cylindrical sleeve 7, and in the outside of an enlarged portion 15 of a cylindrical wall 11 of a corresponding closure cap 21. The top surface of a protrusion part 19 protruded over the horizontal surface so that it forms the upper end of the skirt 6 at the upper end of the cylindrical sleeve 7 is coupled with a surface that supports the disk portion 22 of the closure cap 21, thereby serving to guide a movement of the closure cap 21 upon opening of the side apertures 9 due to the upward movement of the closure cap 21. 27 represents a beverage accommodated in the container 1.

The closure cap 21 includes a cylindrical wall 11 having the circumference of the lower end thereof coupled with the transverse wall 8 so that the closure cap 21 is sealed when the cylindrical wall 11 is initially coupled with the transverse wall 8; a disk portion 22 that performs a stopper function at the upper end of the cylindrical wall 11 when the closure cap 21 falls down; and a dome 25 protruded and connected to a separation groove 26 at the center of the upper end of the disk portion 22 when the dome 25 is separated from the cylindrical wall 11 for communication. 12 represents a lower end having a smaller inside diameter than the cylindrical wall 11 so that it is sealed with the transverse wall 8 and opens the holes 9 when the closure cap 21 rises. 17 represents a flange supporting the disk portion 22. 23, 24 are the disk sides of the disk portion 22.

However, such a structure has been designed so that, when the closure cap 21 rises, a plurality of side apertures 9 on the outside of the lower end of the cylindrical sleeve 7 that forms the stopper 2 are open and the additive 28 is discharged into the container, and at normal times, the additive 28 maintains a sealing state by the transverse wall 8 and a rim 13 which is the end of the lower end 12 having a smaller diameter than the lower part of the cylindrical wall 11. However, if a product is completed, a molding error occurs due to injection molding, penetration of moisture is made due to the nature of synthetic resin materials, a problem arises from the penetration of moisture because the separation groove 26 of the dome 25 is thin. Consequently, an additive powder becomes hard or deformed.

As another technical approach, the cap for storage chamber wherein a protrusion screw portion is placed outside the protrusion part of a stopper, the disk portion of a closure cap is screwed onto the protrusion screw portion, a window for discharging an additive and a horizontal wall are placed in the cylindrical sleeve of the stopper, a whirling pin for whirling an additive is formed in the horizontal wall, and the function of up and down moving means for opening a hole for discharging an additive has been completed by rising the closure cap and mixing an additive with the whirling pin when a screw is unscrewed, has been developed, for example, in U.S. Pat. No. 7,546,919 (inventor: Lee, Jungmin). However, such cap has disadvantages: a shape is deformed due to a lapse of time and a change of temperature, there is a problem in the sealing property because sealing is performed only on one side, and it is likely to make a penetration of moisture.

As another method for solving the problems associated with the sealing property, a new technology in which an elastic attachment/detachment valve is formed only at a portion that greatly requires sealing, the assembling property is improved by temporarily closing an additive upon coupling, and an additive remains in a fixed lower cap upon use after assembling, thereby separating a moving member that is an upper cap and so adding and using the additive, has been developed in WO2005/051775 (inventor: CHO, Youngkook). However, because the attachment/detachment valve must be separately provided in addition to the upper and lower caps, there exists a problem in that the production cost may be increased.

In order to solve the problems, a container stopper designed to deform a shape of the attachment/detachment valve and add a bridge to the lower end of the slider of the lower cap, thereby preventing from separation of the attachment/detachment valve, and also to maintain a binding force and maximize the sealing property upon coupling of the attachment/detachment valve, has been developed in Korean Laid-open Patent Publication No. 10-2011-0086488 (inventor; CHO, Youngkook). However, there remains a problem in the sealing property due to the deformation of the shapes of the attachment/detachment valve and the slider. Further, because an elastic force is reduced if the attachment/detachment valve and the slider are deformed for a long time, it is difficult to maintain an initial sealing property.

DISCLOSURE

Technical Problem

The present invention has been made to solve the problems, and an object of the present invention is to provide a container cap which comprises: a storage member that is coupled with the mouth portion of a container and that includes outlet ports on the side of the lower end of an inner cap coupled with the inside of the mouth portion of a bottle; an opening member that is coupled with the storage member and that includes a slider accommodating and discharging an additive while moving up and down; a bottom gasket that is sealed up and coupled with the inside surface, lower end surface, and lower outside surface of the lower end of the slider in three directions, thereby having a capping function of the additive; and a bottom inside stopper formed at the lower end of the inner cap so that it dually seals the outside surface of the lower end, bottom surface, and inside surface of the bottom gasket in the three directions at the same time. Accordingly, because the bottom gasket and the bottom inside stopper dually support the inside, lower end, and outside surfaces of the slider in the three directions at the same time, the sealing property is improved and deformation of the shape is reduced.

Another object of the present invention is to provide a container cap which comprises a storage member that is coupled with the mouth portion of a container and that includes outlet ports on the side of the lower end of an inner cap coupled with the inside of the mouth of a bottle; an opening member that is coupled with the storage member and that includes a slider accommodating and discharging an additive while moving up and down; a bottom gasket that is sealed up and coupled with the inside surface, lower end surface, and outside surface of the lower end of the slider in three directions, thereby having a capping function of the additive; and a bottom inside stopper formed at the lower end of the inner cap so that it dually seals the outside surface of the lower end, bottom surface, and inside surface of the bottom gasket in the three directions at the same time. As such, according to the present invention, the bottom gasket is separately formed, materials suitable for the sealing property and moisture resistance can be selected depending on a desired use to mold only the bottom gasket. Accordingly, the container cap of the present invention is economical.

Yet another object of the present invention is to provide a container cap which comprises: a storage member that is coupled with the mouth portion of a container and that includes outlet ports on the side of the lower end of an inner cap coupled with the inside of the mouth of a bottle; an opening member that is coupled with the storage member and that includes a slider accommodating and discharging an additive while moving up and down; a bottom gasket that is sealed up and coupled with the inside surface, lower end surface, and outside surface of the lower end of the slider in three directions, thereby having an capping function of the additive; and a bottom inside stopper formed at the lower end of the inner cap so that it dually seals the outside surface of the lower end, bottom surface, and inside surface of the bottom gasket in the three directions at the same time. As such, according to the present invention, the bottom on the outside and inside surface of the bottom gasket can be dually supported by the bottom inside stopper integrally formed with the lower end of the outlet ports of the inner cap at the same time to thereby maintain a constant shape without deformation.

Technical Solution

To this end, the present invention provides a container cap for accommodating and discharging an additive using a bottom gasket, which comprises:

a storage member that is a lower cap having outlet ports on the side of the lower end of a tubular inner cap configured to be placed within the mouth of a container in a main cap coupled with the mouth of the container;

an opening member configured to include a slider with a container function of the additive guided up and down into the internal diameter of the inner cap and coupled with an extension tube extending upward from the main cap;

a bottom gasket configured to close the lower end and inside surface of the slider, coupled with the storage member through hooking, and separated from the slider upon separation of the opening member; and a bottom inside stopper integrally installed at the lower end of the outlet ports and configured to closely attach and seal the outside, bottom, and inside surfaces of the bottom gasket simultaneously.

Advantageous Effects

As described above, the container cap of the present invention comprises a storage member that is coupled with the mouth portion of the container and that includes the outlet ports on the side of the lower end of the inner cap coupled with the inside of the mouth of a bottle; an opening member that is coupled with the storage member and that includes the slider accommodating and discharging an additive while moving up and down; a bottom gasket that is sealed up and coupled with the inside surface, lower end surface, and outside surface of the lower end of the slider in the three directions, thereby having a capping function of the additive; a bottom inside stopper formed at the lower end of the inner cap so that it dually seals the outside surface of the lower end, bottom surface, and inside surface of the bottom gasket in the three directions at the same time. As such, according to the present invention, since the bottom gasket and the bottom inside stopper dually support the inside, lower end, and outside surfaces of the slider in the three directions at the same time, the sealing property is improved and deformation of the shape is reduced The container cap of the present invention comprises a storage member that is coupled with the mouth portion of the container and that includes the outlet ports on the side of the lower end of the inner cap coupled with the inside of the mouth of a bottle; an opening member that is coupled with the storage member and that includes the slider accommodating and discharging an additive while moving up and down; a bottom gasket that is sealed up and coupled with the inside surface, lower end surface, and outside surface of the lower end of the slider in the three directions, thereby having a capping function of the additive; and a bottom inside stopper formed at the lower end of the inner cap so that it dually seals the outside surface of the lower end, bottom surface, and inside surface of the bottom gasket in the three directions at the same time. As such, according to the present invention, the bottom gasket is separately formed, materials suitable for the sealing property and moisture resistance can be selected depending on a desired use to mold only the bottom gasket. Accordingly, the container cap of the present invention is economical.

The container cap of the present invention comprises a storage member that is coupled with the mouth portion of the container and that includes the outlet ports on the side of the lower end of the inner cap coupled with the inside of the mouth of a bottle; an opening member that is coupled with the storage member and that includes the slider accommodating and discharging an additive while moving up and down; a bottom gasket that is sealed up and coupled with the inside surface, lower end surface, and outside surface of the lower end of the slider in the three directions, thereby having a capping function of the additive; and a bottom inside stopper formed at the lower end of the inner cap so that it dually seals the outside surface of the lower end, bottom surface, and inside surface of the bottom gasket in the three directions at the same time. As such, according to the present invention, the bottom on the outside and inside surface of the bottom gasket can be dually supported by the bottom inside stopper integrally formed with the lower end of the outlet ports of the inner cap at the same time to thereby maintain a constant shape without deformation.

BEST MODE FOR INVENTION

Figure 1:
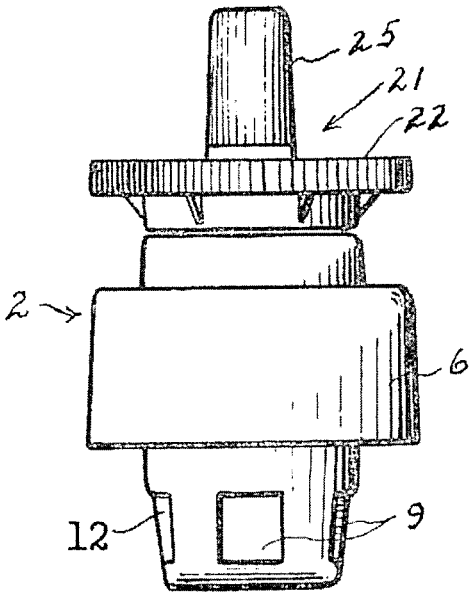
Fig.1 PRIOR ART
FIG. 1 is a front perspective view illustrating the state in which a stopper fixed to the mouth of a container is coupled with a conventional closure cap for discharging internal additives to a stopper window while moving up and down in the stopper.
Figure 2:
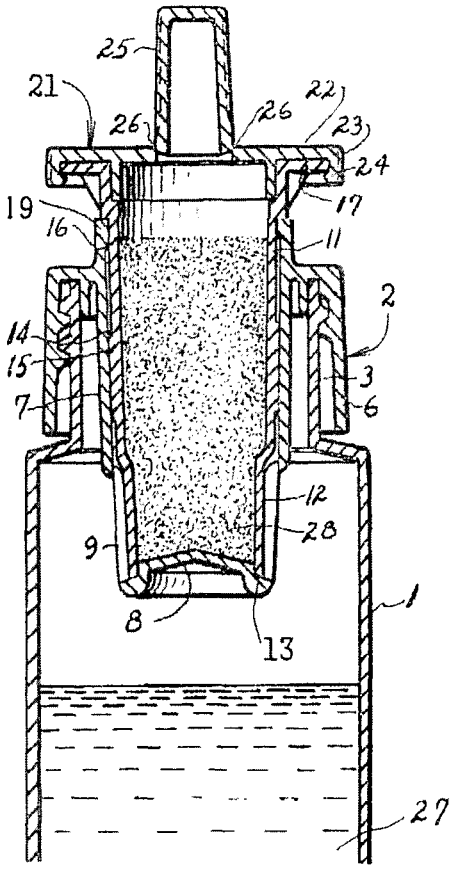
Fig.2 PRIOR ART
FIG. 2 is a cross-sectional view illustrating the coupling state with the mouth of the container of FIG. 1.
Figure 3:
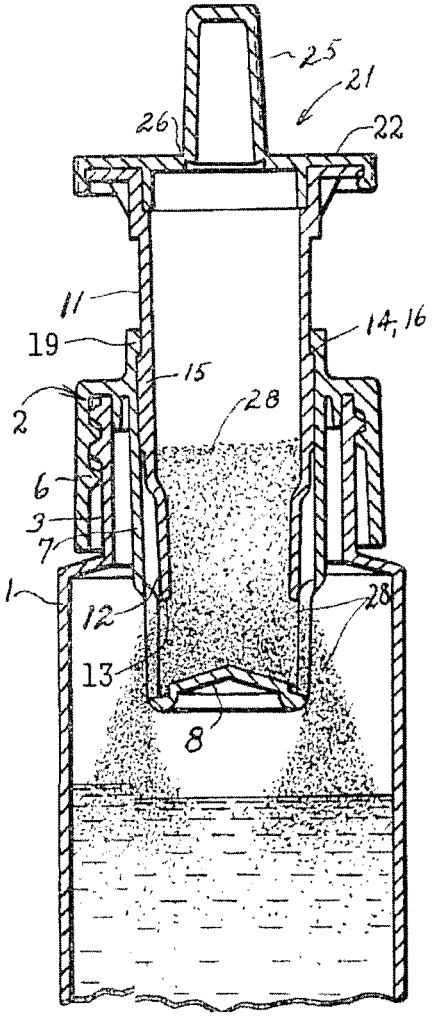
Fig.3 PRIOR ART
FIG. 3 is a cross-sectional view illustrating the use state of FIG. 2.
Figure 4:
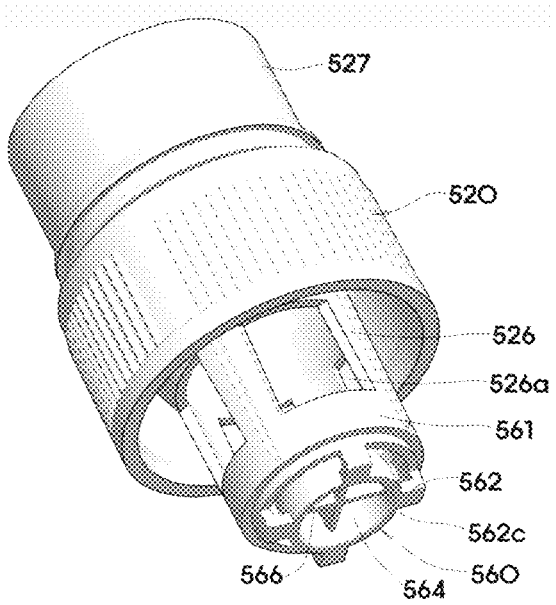
FIG. 4 is a perspective view of a storage member according to the present invention.
Figure 5:
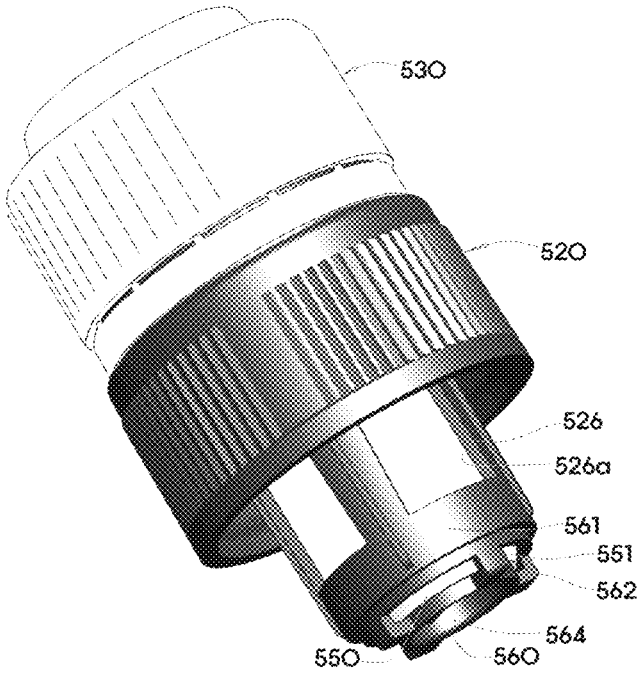
FIG. 5 is a perspective view of an assembly state according to the present invention.
Figure 6:
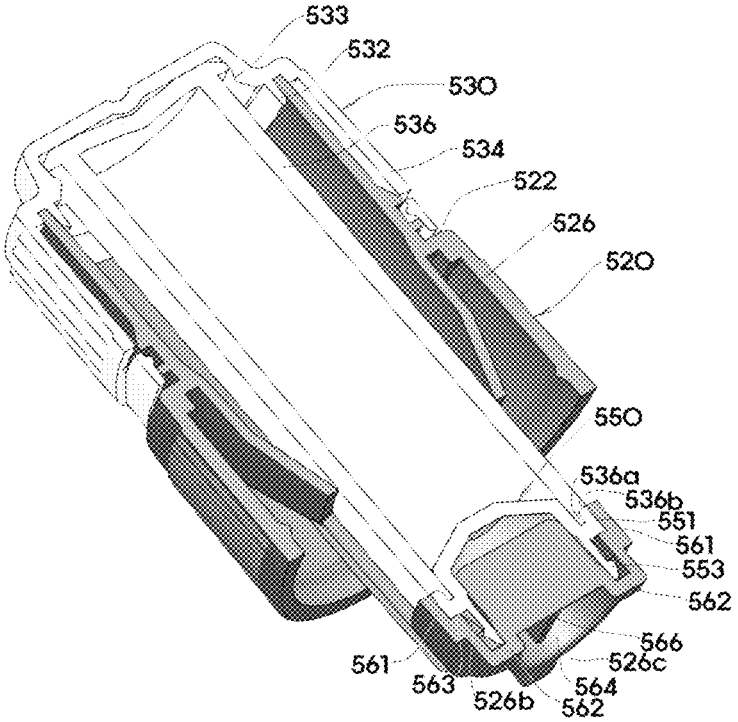
FIG. 6 is a perspective view of the half section according to the present invention.
Figure 7:
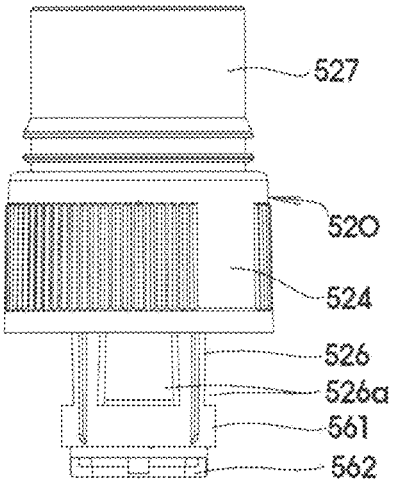
FIG. 7 is a front view of a storage member according to the present invention.
Figure 8:
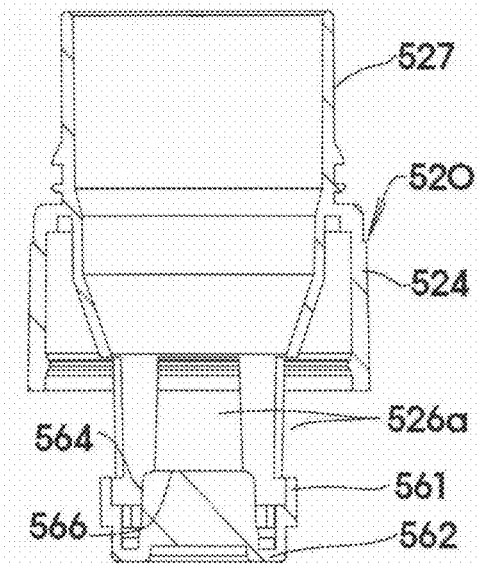
FIG. 8 is a vertical cross-sectional view of FIG. 7.
Figure 9:
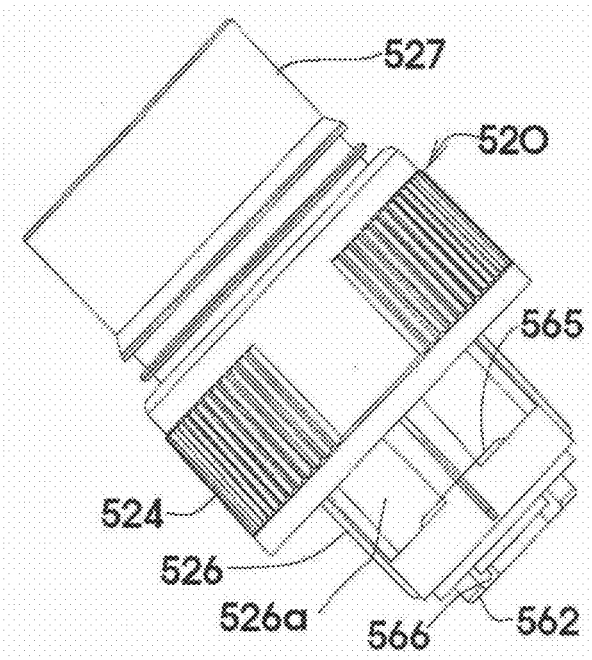
FIG. 9 is a front view of the storage member rotated at 45 degrees in FIG. 7.
Figure 10:
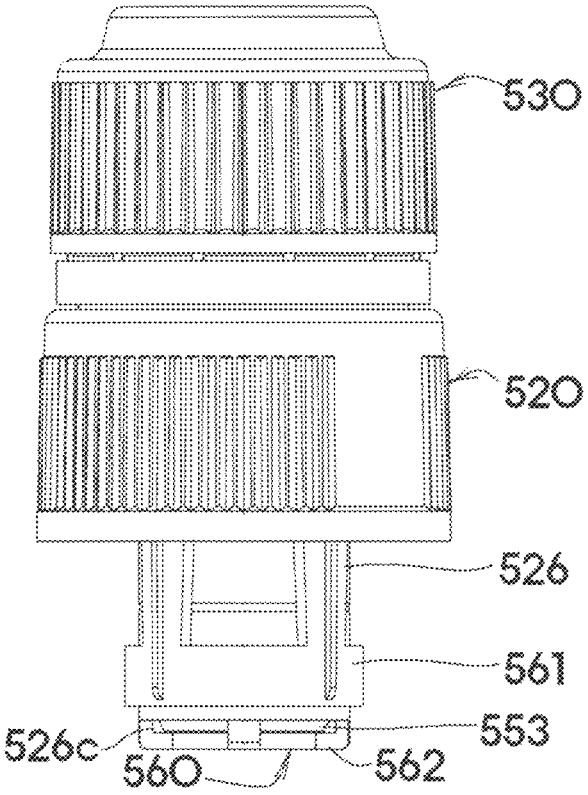
FIG. 10 is a front view of the coupling state according to the present invention.
Figure 11:
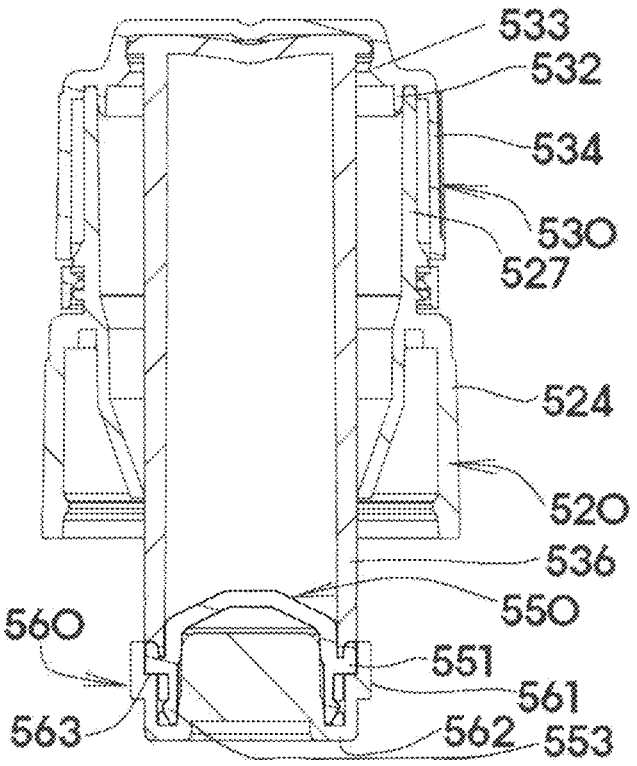
FIG. 11 is a vertical cross-sectional view of FIG. 10.
Figure 12:
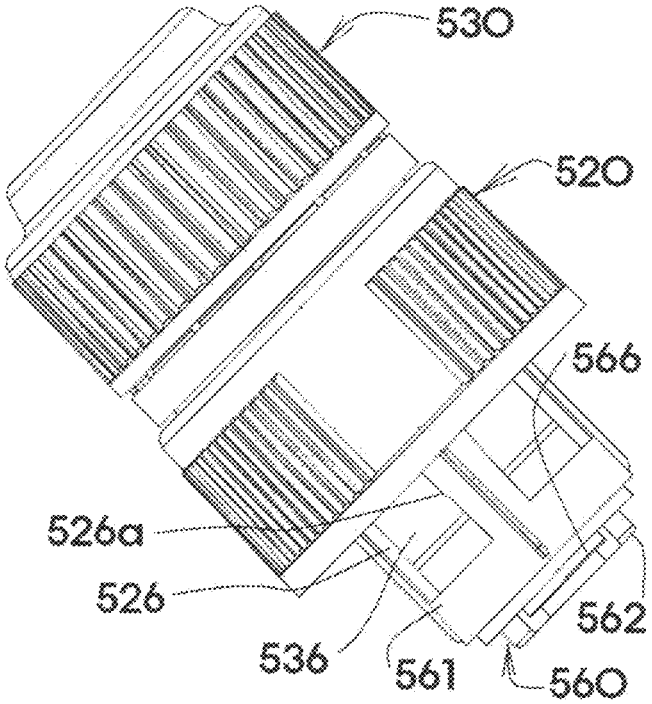
FIG. 12 is a front view of the storage member rotated at 45 degrees in FIG. 10.
Figure 13:
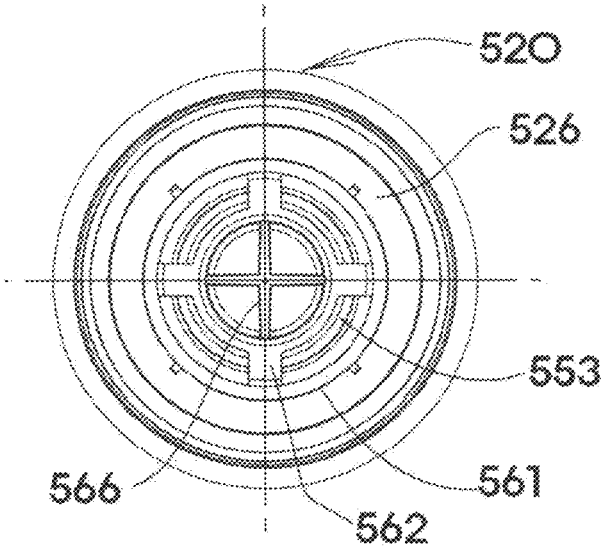
FIG. 13 is a bottom view of FIG. 10.

The present invention is directed to a container cap for accommodating and discharging an additive using a bottom gasket, comprising:

a storage member 520 that is a lower cap having outlet ports 526*a* on the side of the lower end of a tubular inner cap 526 configured to be placed within the mouth of a container 1 in a main cap 524 coupled with the mouth of the container;

an opening member 530 configured to have a slider 536 of an additive container function guided up and down into the internal diameter of the inner cap 526 and coupled with an extension tube 527 extending upwardly from the main cap 524;

a bottom gasket 550 configured to close the lower end and inside surface of the slider 530, hook-coupled with the storage member 520, and separated from the slider 530 upon separation of the opening member 536; and a bottom inside stopper 560 integrally installed at the lower end of the outlet ports 526*a* and configured to closely attach and seal the outside, bottom, and inside surfaces of the bottom gasket 550 at the same time.

MODE FOR THE INVENTION

Embodiments of the present invention are described in detail with reference to the accompanying drawings.

The present invention provides a container cap for accommodating and discharging an additive using a bottom gasket, comprising:

a storage member 520 which is a lower cap having outlet ports 526*a* on the side of the lower end of a tubular inner cap 526 configured to be placed within the mouth of a container 1 in a main cap 524 coupled with the mouth of the container;

an opening member 530 configured to have a slider 536 of an additive container function guided up and down into the inside diameter of the inner cap 526 and coupled with an extension tube 527 extending upwardly from the main cap 524;

a bottom gasket 550 configured to close the lower end and inside surface of the slider 530, hook-coupled with the storage member 520, and separated from the slider 530 upon separation of the opening member 536; and a bottom inside stopper 560 integrally installed at the lower end of the outlet ports 526*a* and configured to closely attach and seal the outside, bottom, and inside surfaces of the bottom gasket 550 at the same time. In FIGS. 4, 6, 7, 8, 9, and 11, the illustration of a screen or hook structure is omitted because the outside of the extension tube 527 and the inside of the main cap 524 of the storage member 520 and the inside of an upper cap may be selectively implemented using screw coupling, hook coupling and the like. The slider 536 has the bottom open, the top closed, and an upper edge form a protrusion jaw. A sealing dam 532 is placed in an upper cap 534 corresponding to the lower cap with the extension tube 527 interposed between the sealing dam 532 and the upper cap 534 so that the sealing dam 532 has a sealing property. A fixing jaw 533 is placed on the inside of the sealing dam 532 so that the fixing and coupling of the slider 536 are available, but it enables to maintain a fixing state once the fixing jaw 533 is coupled with the slider 536.

A sealing thread 536*a* having a smaller width than the slider lower end 536*b* of the slider 536 is vertically protruded at the lower end of the slider lower end 536*b*. The sealing thread 536*a* is pressed and fit in the sealing groove 552 of the bottom gasket 550. The top surfaces of the slider lower end 536*b* and a sealing ring 551 are configured to come in a surface contact with each other.

The bottom inside stopper 560 is configured to include an inside vertical support portion 564 supporting the inner circumference surface of the bottom gasket 550, horizontal support portions 562 horizontally supporting the outside of the bottom gasket 550 at the lower end of the inside vertical support portion 564, and a side support portion 561 supporting the sealing ring 551 of the bottom gasket 550 at the outer end of the horizontal support portions 562. The horizontal support portions 562 may be integrally molded with the bottom of the inside vertical support portion 564 in a bridge form. The side support portion 561 may also be molded in the form of a bridge having the same width as that of the horizontal support portions 562 corresponding to the side support portion 561, thus providing a passage through which the hook 553 of the bottom gasket 550 communicates in a space 562*c* between bridges.

A sealing ring support jaw 563 supporting the bottom of the outside of the sealing ring 551 is formed within the side support portion 561.

A latching protrusion 526*b* is formed at the lower end of the inside of the sealing ring support jaw 563 and coupled with the hook 553 that is protruded to the outside of the lower end of an extension tube 557 extending downward from the sealing ring 551 of the bottom gasket 550.

The top surface of the inside vertical support portion 564 is configured to be covered with an inside upper support portion 565, and the inside of the inside vertical support portion 564 is configured to be supported by a plurality of ribs 566 for reinforcing strength.

Figure 15:
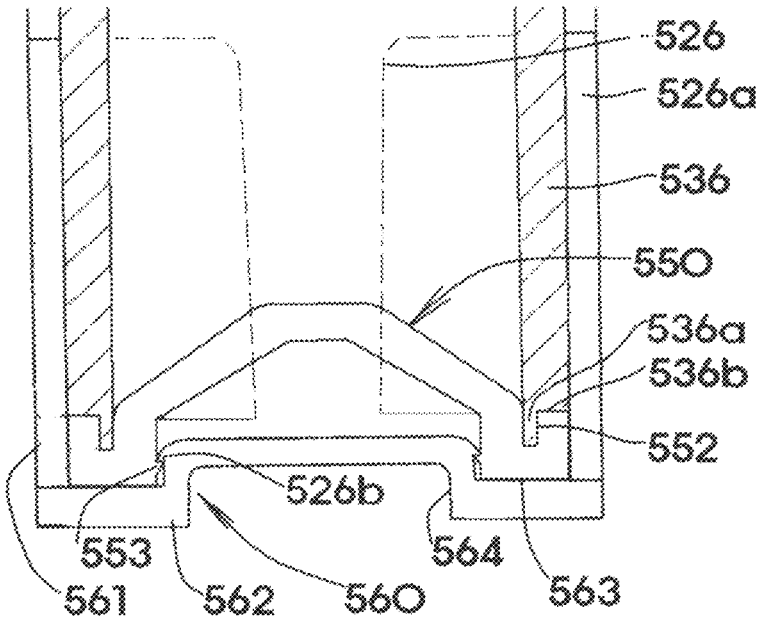
FIG. 15 is an enlarged cross-sectional view of major parts according to a second embodiment of the present invention.

As illustrated in FIG. 15, the bottom inside stopper 560 is configured to include the inside vertical support portion 564 supporting the inner circumference surface of the bottom gasket 550, the horizontal support portions 562 horizontally supporting the outside of the inside vertical support portion 564 at the lower end thereof, the side support portion 561 supporting the sealing ring 551 of the bottom gasket 550 at the end of the outside of the horizontal support portions 562, and the latching protrusion 526*b* protruded to the outer side of the inside vertical support portion 564, protruded to the outer side of the bottom gasket 550, and hook-coupled with the hook 553 protruded to the inside wall of the bottom of the bottom gasket 550.

Figure 16:
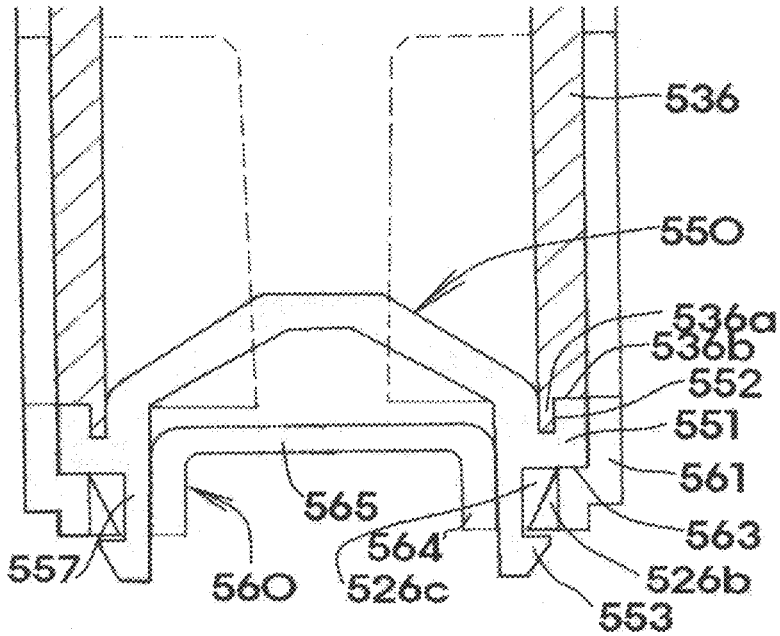
FIG. 16 is an enlarged cross-sectional view of major parts according to a third embodiment of the present invention.

As illustrated in FIG. 16, the bottom inside stopper 560 is configured to include the inside vertical support portion 564 supporting the inner circumference surface of the bottom gasket 550, the horizontal support portions 562 horizontally supporting the outside of the inside vertical support portion 564 at the lower end thereof in a bridge form, and the side support portion 561 supporting the sealing ring 551 of the bottom gasket 550 at the end of the outside of the horizontal support portions 562.

The space 562*c* is formed between the horizontal support portions 562 so that the hook 553 formed on the outside of the lower end of the extension tube 557 extending downwardly from the sealing ring 551 of the bottom gasket 550 is coupled with the latching protrusion 526*b* in such a way as to penetrate the space 563*c*.

Figure 17:
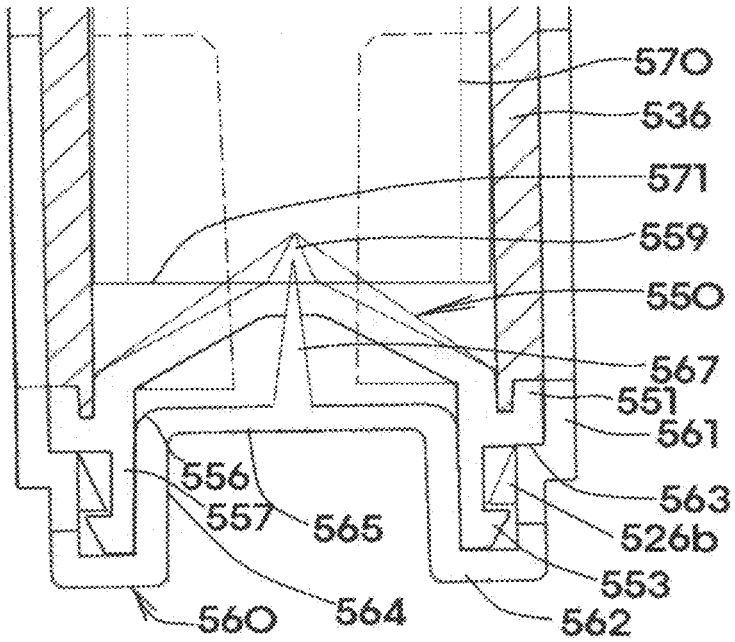
FIG. 17 is an enlarged cross-sectional view of major parts according to a fourth embodiment of the present invention.

As illustrated in FIG. 17, the bottom inside stopper 560 is configured to include the inside vertical support portion 564 supporting the inner circumference surface of the bottom gasket 550, the horizontal support portions 562 horizontally supporting the outside of the inside vertical support portion 564 at the lower end thereof in a bridge form, and the side support portion 561 supporting the sealing ring 551 of the bottom gasket 550 at the end of the outside of the horizontal support portions 562.

The bottom inside stopper 560 is configured to further comprise:

a protrusion pole 567 configured to close the upper end of the inside vertical support portion 564 and protruded over the center of the top surface of the inside upper support portion 565; and a pointed portion 559 protruded from the center of the upper end of the insertion portion 556 fit into the lower end of the inside of the slider 536 of the bottom gasket 550, supported and coupled with the protrusion pole 567 at the bottom of the bottom gasket 550, and configured to have a needle function of a height that breaks an aluminum foil 571 at the lower end of an auxiliary container 570 for reusing an additive within the slider 536 upon recombination.

The present invention configured as described above is primarily capped so that the mouth of the container 1 is coupled with the main cup 524 through screw or hook coupling and the inner cap 526 is placed on the inside wall of the mouth of the container. Of course, in this case, it is assumed that the contents within the container 1 have been accommodated. Further, the lower end of the inner cap 526 is integrally molded with the bottom inside stopper 560 formed of the side support portion 561 extending from the lower end of the outlet ports 526*a*, the horizontal support portions 562 of a bridge form horizontally extended from the side support portion 561 to the inside of the bottom inside stopper 560, and the tubular inside vertical support portion 564 vertically upward bent from the inside end of the horizontal support portions 562. Accordingly, the bottom of the inner cap 526 can maintain a constant shape without deformation.

Subsequently, an additive is accommodated in the slider 536. The bottom gasket 550 in which the sealing thread 536*a* at the lower end of the bottom gasket 550 is coupled with sealing in three faces, that is, the outside and inside of the sealing thread 536*a* and the slider lower end 536*b* of the slider 536, is coupled with the latching protrusion 526*b* through the hook 553. Secondary capping is performed so that the upper cap 534 is coupled with the extension tube 527. Of course, the storage member 520 and the opening member 530 may be mutually capped, and secondary capping may be simultaneously made in the container.

In order for an user to drink the additive, when raising the upper cap 534 by unfastening the upper cap 534 from the extension tube 527, the sealing thread 536*a* at the lower end of the slider 536 is separated from the sealing groove 552, and thus the windows of the outlet ports 526*a* are open. Accordingly, the additive is instantly discharged into the container by the slant surface of the bottom gasket 550, so the contents are introduced into the container.

Furthermore, the user may separate both the storage member 520 and the opening member 530 from the mouth 3 of the container 1 to thereby drink the contents.

In addition, if the storage member 520 and the opening member 530 (in the state in which an additive has been accommodated in the slider 536) are to be kept in the mouth 3 of the container 1, the three faces which are the inside and outside of the sealing thread 536*a* and the slider lower end 536*b* at the lower end of the slider 536 of the present invention, are simultaneously primarily sealed by the sealing ring 551 and insertion portion 556 of the bottom gasket 550.

Thereafter, the outside surface, bottom surface, and inside surface of the sealing ring 551 of the bottom gasket 550 around the sealing thread 536*a* are secondarily sealed by the bottom inside stopper 560 in three directions at the same time. Accordingly, although there is a deformation of the shape upon injection molding or deformation resulting from a temperature change, the sealing property can be maintained by the two-step sealing. The bottom gasket 550 is a separate element. If the bottom gasket 550 is made of elastic materials, such as silicon or rubber, the bottom gasket 550 can maintain the sealing property although it is thin. Also, it can improve functionality because the deformation of the bottom gasket is prevented by the inside stopper at the bottom through the secondary sealing. Furthermore, the prime cost can be achieved because the bottom gasket 550 is made thin and a cost for materials is reduced.

Figure 14:
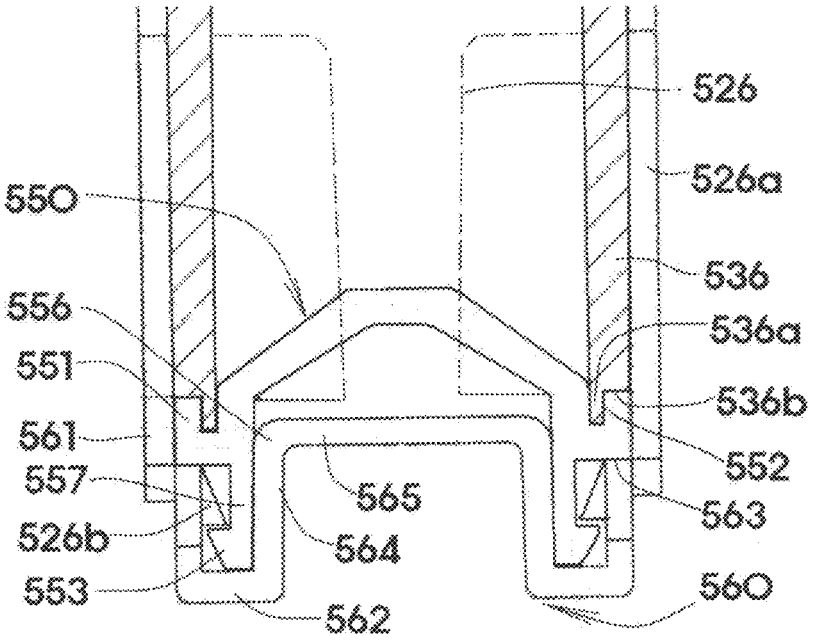
FIG. 14 is an enlarged cross-sectional view of major elements according to a first embodiment of the present invention.

The basic structures of the bottom gasket 550 and bottom inside stopper 560 according to the present invention are shown in FIG. 14. As illustrated in FIG. 15, the hook 553 of the bottom gasket 550 may be formed within the bottom of the bottom gasket 550. As illustrated in FIG. 16, the height of the support portion 561 may be lowered so that the hook 553 is exposed to the bottom.

Further, as illustrated in FIG. 17, if the pointed portion 559 is formed at a portion corresponding to the top of the insertion portion 556 of the bottom gasket 550 and the protrusion pole 567 is supported at the center of the top of the inside upper support portion 565, their function and use principle are the same as the initial function and use principle using an additive. However, if a user puts baby milk or a baby food in a separate auxiliary container 570 without throwing away the container and the cap after use, carries the separate auxiliary container 570 closed by the aluminum foil 571, puts water in the auxiliary container, receives a separate additive in the auxiliary container, inserts the auxiliary container 570 having a lower end closed by the aluminum foil 571 into the inside wall of the slider 536, and couples the bottom inside stopper 560 and bottom gasket 550 of the storage member 520, the aluminum foil 571 is ruptured and at the same time, the auxiliary additive is accommodated in the slider 536. The user may then drink the contents within the auxiliary container by opening the opening member 530 and the storage member 520.

INDUSTRIAL APPLICABILITY

According to the present invention, because the bottom gasket and the bottom inside stopper dually support the inside, lower end, and outside surfaces of the slider lower end in three directions at the same time, the sealing property is improved and deformation of the shape is reduced According to the present invention, the bottom gasket is separately provided, and materials suitable for the sealing property and moisture resistance can be selected depending on a desired use to thereby mold only the bottom gasket. Therefore, the container cap of the present invention is economical.

According to the present invention, the bottom surface of the outside and inside surface of the bottom gasket can be dually supported by the bottom inside stopper integrally molded with the lower end of the outlet ports of the inner cap at the same time, to thereby maintain a constant shape without deformation of the shape.

The invention claimed is:

1. A container cap for accommodating and discharging an additive using a bottom gasket, comprising:

a storage member that is a lower cap having outlet ports on a side of a lower end of a tubular inner cap configured to be placed within a mouth of a container in a main cap coupled with the mouth of the container;

an opening member configured to have a slider of a container function of the additive guided up and down into an inside diameter of the inner cap and coupled with an extension tube extending upwardly from the main cap;

a bottom gasket configured to close a lower end and inside surface of the slider, coupled with the storage member through hooking, and separated from the slider upon separation of the opening member; and a bottom inside stopper integrally installed at a lower end of the outlet ports and configured to closely attach and seal outside, bottom, and inside surfaces of the bottom gasket simultaneously.

2. The container cap of claim 1, wherein:

a sealing thread having a smaller width than a slider lower end is vertically protruded on an inside of the slider lower end of the slider, the sealing thread is pressed and fit in a sealing groove of the bottom gasket, and top surfaces of the slider lower end and a sealing ring are configured to come in a surface contact with each other.

3. The container cap of claim 2, wherein the bottom inside stopper is configured to comprise:

an inside vertical support portion supporting the inner circumference surface of the bottom gasket, horizontal support portions horizontally supporting the outside of the bottom gasket at the lower end of the inside vertical support portion, and a side support portion supporting the sealing ring of the bottom gasket at the outer end of the horizontal support portions.

4. The container cap of claim 3, wherein a sealing ring support jaw supporting a bottom of an outside of the sealing ring is formed within the side support portion.

5. The container cap of claim 4, wherein a latching protrusion is formed at a lower end of an inside of the sealing ring support jaw and coupled with a hook that is protruded in an outside of a lower end of an extension tube extending downwardly from the sealing ring of the bottom gasket.

6. The container cap of claim 3, wherein:

a top surface of the inside vertical support portion is configured to be covered with an inside upper support portion, and an inside of the inside vertical support portion is configured to be supported by a plurality of ribs for reinforcing strength.

7. The container cap of claim 2, wherein the bottom inside stopper is configured to comprise:

an inside vertical support portion supporting an inner circumference surface of the bottom gasket, horizontal support portions horizontally supporting an outside of the inside vertical support portion at a lower end thereof in a bridge form, a side support portion supporting the sealing ring of the bottom gasket at an end of an outside of the horizontal support portions, and a latching protrusion protruded to an outer side of the inside vertical support portion, protruded to an outer side of the bottom gasket, and hook-coupled with a hook protruded to an inside wall of a bottom of the bottom gasket.

8. The container cap of claim 2, wherein the bottom inside stopper is configured to comprise:

an inside vertical support portion supporting an inner circumference surface of the bottom gasket, horizontal support portions horizontally supporting an outside of the inside vertical support portion at a lower end thereof in a bridge form, and a side support portion supporting the sealing ring of the bottom gasket at an end of an outside of the horizontal support portions, wherein a space is formed between the horizontal support portions so that the hook formed on an outside of a lower end of an extension tube extending downward from the sealing ring of the bottom gasket is combined in such a way as to pass through the space.

9. The container cap of claim 2, wherein the bottom inside stopper is configured to comprise:

an inside vertical support portion supporting an inner circumference surface of the bottom gasket, horizontal support portions horizontally supporting an outside of the inside vertical support portion at a lower end thereof in a bridge form, and a side support portion supporting the sealing ring of the bottom gasket at an end of an outside of the horizontal support portions; and the bottom inside stopper is configured to further comprise:

a protrusion pole configured to close an upper end of the inside vertical support portion and protruded over a center of a top surface of an inside upper support portion, and a pointed portion protruded from a center of an upper end of an insertion portion fit into a lower end of an inside of the slider of the bottom gasket, supported and coupled with the protrusion pole at a bottom of the bottom gasket, and configured to have a needle function of a height that breaks an aluminum foil at a lower end of an auxiliary container for reusing an additive within the slider upon recombination.

* * * * *